US009848641B2

(12) United States Patent
Wollin

(10) Patent No.: US 9,848,641 B2
(45) Date of Patent: Dec. 26, 2017

(54) NICOTINE DELIVERY SYSTEM

(76) Inventor: John Wollin, Lidingo (SE)

( * ) Notice: Subject to any disclaimer, the term of this patent is extended or adjusted under 35 U.S.C. 154(b) by 0 days.

(21) Appl. No.: 13/380,657

(22) PCT Filed: Jun. 18, 2010

(86) PCT No.: PCT/SE2010/000171
§ 371 (c)(1),
(2), (4) Date: Feb. 14, 2012

(87) PCT Pub. No.: WO2011/002375
PCT Pub. Date: Jan. 6, 2011

(65) Prior Publication Data

US 2012/0125353 A1 May 24, 2012

(30) Foreign Application Priority Data

Jun. 29, 2009 (SE) ..... 0900880-6

(51) Int. Cl.
*A24F 47/00* (2006.01)

(52) U.S. Cl.
CPC ..... *A24F 47/00* (2013.01)

(58) Field of Classification Search
USPC ..... 131/270–273
See application file for complete search history.

(56) References Cited

U.S. PATENT DOCUMENTS 4,756,964 A * 7/1988 Kincaid ..... B05D 1/62 156/272.6
4,800,903 A * 1/1989 Ray et al. ..... 131/273
4,809,876 A * 3/1989 Tomaswick ..... B29C 71/04 220/62.12
5,364,666 A * 11/1994 Williams et al. ..... 427/579
5,400,808 A 3/1995 Turner et al.
6,112,695 A * 9/2000 Felts ..... C23C 16/045 118/723 E
2002/0041942 A1* 4/2002 Kuehnle ..... B29B 13/08 428/35.7
2003/0194517 A1* 10/2003 Shi et al. ..... 428/35.7
2004/0055613 A1* 3/2004 Horian ..... 131/194
2004/0071885 A1* 4/2004 Hutchinson ..... B05D 1/18 427/385.5
2004/0182403 A1 9/2004 Andersson et al.
2005/0284550 A1* 12/2005 Bicker ..... C23C 16/0272 148/692
2006/0121222 A1* 6/2006 Andrich ..... B65D 23/02 428/35.7
2006/0257460 A1* 11/2006 Jansen et al. ..... 424/448
2007/0031463 A1* 2/2007 Fotinos et al. ..... 424/405
2007/0062548 A1* 3/2007 Horstmann et al. ..... 131/270
2007/0259146 A1* 11/2007 Darr et al. ..... 428/35.7
2008/0302375 A1* 12/2008 Andersson ..... 131/273

FOREIGN PATENT DOCUMENTS

WO WO 2007051340 A1 * 5/2007 ..... C23C 16/40

* cited by examiner

*Primary Examiner* — Eric Yaary

(74) *Attorney, Agent, or Firm* — Pierce Atwood LLP; Kevin M. Farrell; David J. Wilson

(57) ABSTRACT

The present invention relates to a nicotine inhaling device and a method for making the same. Such device allows a user to ingest nicotine vapours orally and it is primarily intended to be used as a smoking cessation aid.

6 Claims, No Drawings

NICOTINE DELIVERY SYSTEM

The present invention relates to a nicotine delivery system and a method for making the same. Additionally the invention relates to a nicotine inhaling device which allows a user to ingest nicotine vapours orally. The nicotine inhaling device of the present invention is primarily directed to a device which can be used as a smoking cessation aid.

BACKGROUND OF THE INVENTION

A number of attempts have been made over the years to create useful aids to assist the smokers to deal with their nicotine addictions. The most successful product for this purpose has been nicotine chewing gums. Another type of product for this purpose was a smokeless cigarette which however could not satisfy FDA requirements. Since oral ingestion of nicotine vapours was considered to be a very effective way to aid in smoking cessation a lot of developments have been made to create good and safe products in this respect. Such products have been described in detail in e.g. the U.S. Pat. Nos. 4,736,755, 4,917,120, 5,167,242, 5,400,808, 5,501,236 and 6,098,632, the contents of which are incorporated in this patent application. A product based on one or more of these patents have been developed and marketed under the brand name Nicorette® Inhaler®. In this product the nicotine is loaded in a porous polyolefin plug which plug is enclosed in a cylinder (cartridge) being made of an injection moulded impact modified acrylonitrile-methyl acrylate copolymer (Barex® from BP Lima Chemicals, 1900 FORT AMANDA ROAD, LIMA, Ohio, US). The atmosphere in the cylinder is evacuated and replaced by nitrogen gas. Both ends of the cylinder are sealed with aluminium foil. The foil has also a layer of the same copolymer (Barex®) that is heat sealed on the cylinder edges.

The very specific modified acrylonitrile-methyl acrylate copolymer used for this purpose has turned out to be very expensive. It has now surprisingly been found that a much less expensive material may be used to replace this copolymer and the invention is based on this finding.

THE INVENTION

Studies have shown that it should be possible to use a polymer material such as polyethyleneterephtalate (PET) which has been subjected to surface modification by deposition of Inorganic Oxides or Amorphous Carbon coatings. The coating provides about 5-10× improvement of the oxygen impermeability and 2-4× of the water vapor impermeability.

The required investments in machinery are reasonable and the capacity will enable a short payback time and a considerable sustainable cost saving.

The technique for surface modification has developed so the application can be realised. Coating the inside and/or outside of 3D polymeric surfaces and for coating 2D surfaces with Inorganic Oxides or Amorphous Carbon to enhance their gas and vapour barrier properties as well as their electrical, optical, tribological and other properties is already commonly used.

Current areas of application include:

Beverages (including water, alcoholic and non-alcoholic)
Food Packaging
Medical Plastics and Packaging
Semiconductors
Lithium Batteries There are different techniques available for achieving the desired plasma coating. Among those we have found that the methods and devices for plasma coating described in e.g. the U.S. Pat. Nos. 6,015,595, 6,112,695, 6,180,191, 6,177,142, 6,180,185 and 6,539,890 are very useful. The contents of these patents are incorporated in this application.

Other examples of coating with Inorganic Oxides or Amorphous Carbon we incorporated in this application are the following:

Felts, John T., "Plasma Deposited Silica Coatings for High Barrier Film and Rigid Containers", COEX 89 Conference, Princeton, N.J., 1989

Pasqui, A., Scateni, G., Beccaria, C., "Review of Processes for Clear Barrier Coating Today Available on the Market", First Symposium of European Vacuum Coaters, Anzio, Italy, June 20-22, 1994

Johansson, Kenth S., "Gas Barrier Properties of Plasma-deposited coatings—Substrate Effects", Polymer Surface Modification: Relevance to Adhesion, vol. 2 (Ed. K. L. Mittal), VSP, 2000

Naima Boutroy, Yann Pernel, J. M. Rius, Florence Auger, H. J. von Bardeleben, J. L. Cantin, F. Abel, Andreas Zeinert, C. Casiraghi, A. C. Ferrari and J. Robertson "Hydrogenated amorphous carbon film coating of PET bottles for gas diffusion barriers", Diamond and related Matters, Volume 15, Issues 4-8, April-August 2006, Pages 921-927

By for example using these techniques described above, plastic and metallic based vacuum system for RF (kHz and MHz) or micro wave PECVD (Plasma Enhanced Chemical Vapor Deposition) or PVD (Physical Vapour Deposition) deposition of Inorganic Oxides or Amorphous Carbon onto the inside and/or outside of containers will create the following advantages over the prior art:

Extensive use of inexpensive plastics (cost reduction/simplification)
Good barrier properties inside cylinder with Inorganic Oxide or Amorphous Carbon coating.
End-User verified Product Performance—Passes all tests
Modular design—readily scalable
Coat inside and outside at the same time The equipment based on the technique described above covers the surfaces precisely considering the size and geometry of the part. It is no problem to coat a cylindrical part with open ends. The system is currently able to hold +/−10% uniformity for a 15-20 nm thick coating from the opening to the centre.

Both inner and/or outer surfaces would be covered with the process. This is advantageous as it could give a double barrier in a one or several step process.

The thickness of the coating is controlled by power and speed in the machine. One way that a pinhole free coating can be guaranteed is if the surface to be coated would be particle free. This is achieved by installing laminar flow surroundings between moulding and the coating machine and running it on line.

PET is the recommended polymer since we have the most experience with it and due to that it have the right surface structure for nano coating. Typically, the coating provides 5-10× improvement for oxygen barrier and 2-4× for water vapour barrier.

The compatibility to aggressive substances for the plasma-coated PET surface is excellent as the coating would be characterised as quartz i.e. more clean than glass as it does not contain iron and sodium. This means that substances may not migrate into the material or vice versa. The coating was tested with typical food additives and some solvents including acetone. The coating allowed PET containers to remain structurally sound when filled with acetone and stored.

What is claimed is:

1. A nicotine inhaling device with an extended shelf life, containing a measured amount of nicotine in a gas atmosphere which can selectively be made accessible to a user by oral ingestion of vapors, comprising:

a) a nicotine reservoir for holding and dispersing a measured amount of nicotine;

b) a substantially cylindrical nicotine impermeable barrier formed as part of the nicotine reservoir, having a first open end and a second open end and an internal surface and an external surface, said nicotine barrier layer consisting essentially of a polyethylene terephthalate (PET) which has been subjected to surface modification with Inorganic Oxides or Amorphous Carbon on both the internal and external surfaces; and c) a first seal and a second seal, the first seal being heat sealed to the first open end and the second seal being heat sealed to the second open end to form a continuous nicotine impermeable barrier so that the nicotine is prevented from migrating outside the reservoir.

2. The nicotine inhaling device of claim 1, wherein said polymer has been subjected to surface modification with Amorphous Carbon.

3. The nicotine inhaling device of claim 1, wherein said polymer has been subjected to surface modification with Inorganic Oxides.

4. A nicotine inhaling device with an extended shelf life, containing a measured amount of nicotine in a gas atmosphere which can selectively be made accessible to a user by oral ingestion of vapors, comprising:

a) a nicotine reservoir for holding and dispersing a measured amount of nicotine;

b) a substantially cylindrical nicotine impermeable barrier formed as part of the nicotine reservoir, having a first open end and a second open end and an internal surface and an external surface, said nicotine barrier layer consisting of a polyethylene terephthalate (PET) polymer which has been subjected to surface modification with Inorganic Oxides or Amorphous Carbon on both the internal and external surfaces; and c) a first aluminum seal and a second aluminum seal, the first aluminum seal being heat sealed to the first open end and the second aluminum seal being heat sealed to the second open end to form a continuous nicotine impermeable barrier so that the nicotine is prevented from migrating outside the reservoir.

5. The nicotine inhaling device of claim 1, wherein said surface modification of inorganic oxides or amorphous carbon is from about 15 nm to about 20 nm thick.

6. The nicotine inhaling device of claim 1, wherein said surface modification of said impermeable barrier is a pinhole free coating.

* * * * *